US010768562B2

(12) United States Patent
Sakai et al.

(10) Patent No.: US 10,768,562 B2
(45) Date of Patent: Sep. 8, 2020

(54) IMAGE FORMING APPARATUS

(71) Applicant: KONICA MINOLTA, INC., Chiyoda-ku, Tokyo (JP)

(72) Inventors: Katsuhide Sakai, Toyokawa (JP); Yasuhiro Koide, Toyohashi (JP); Toshiaki Tanaka, Toyokawa (JP); Akihiro Hayashi, Okazaki (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 16/534,426

(22) Filed: Aug. 7, 2019

(65) Prior Publication Data

US 2020/0073301 A1 Mar. 5, 2020

(30) Foreign Application Priority Data

Sep. 5, 2018 (JP) ..... 2018-165745

(51) Int. Cl.
*G03G 15/00* (2006.01)

(52) U.S. Cl.
CPC ..... *G03G 15/50* (2013.01)

(58) Field of Classification Search
CPC ..... G03G 15/50; G03G 15/55; G03G 15/80; G03G 15/553; G03G 15/5004; G03G 15/5008
See application file for complete search history.

(56) References Cited

U.S. PATENT DOCUMENTS

2007/0269229 A1* 11/2007 Maeda ..... G03G 15/55 399/33
2017/0185015 A1* 6/2017 Yoshinaga ..... G03G 15/2039
2017/0190530 A1* 7/2017 Seki ..... H02P 6/16

FOREIGN PATENT DOCUMENTS

JP 2014002233 A 1/2014
JP 2016033582 A 3/2016
JP 2017058640 A 3/2017

* cited by examiner

*Primary Examiner* — Thomas S Giampaolo, II
(74) *Attorney, Agent, or Firm* — Buchanan Ingersoll & Rooney PC

(57) ABSTRACT

An image forming apparatus forms an image on a sheet, and includes: a rotator used to form the image; a motor that drives the rotator rotationally; a current measurer that measures motor current flowing through a current-carrying path including a winding of the motor, at measurement timing that is timing after the motor starts up; a torque acquirer that acquires a torque value of the motor based on a measured value of the motor current; and a corrector that performs correction for cancellation of an amount of error based on one or both of a variation in characteristic corresponding to motor speed of the motor and a variation in characteristic corresponding to the motor current at the measurement timing, at the acquisition of the torque value by the torque acquirer.

10 Claims, 14 Drawing Sheets

70

| | | MEASURED CURRENT VALUE DIm [RATED CURRENT RATIO] | | | | | | | | |
|---|---|---|---|---|---|---|---|---|---|---|
| | | 40% | ··· | 60% | ··· | 80% | ··· | 100% | ··· | 110% |
| MOTOR SPEED V (NUMBER OF REVOLUTIONS) [/min] | 1000 | 0.998 | ··· | 0.996 | ··· | 0.992 | ··· | 0.985 | ··· | 0.980 |
| | 1500 | 0.997 | ··· | 0.995 | ··· | 0.991 | ··· | 0.984 | ··· | 0.978 |
| | 1750 | 0.996 | ··· | 0.994 | ··· | 0.990 | ··· | 0.982 | ··· | 0.975 |
| | 2000 | 0.994 | ··· | 0.993 | ··· | 0.989 | ··· | 0.980 | ··· | 0.972 |
| | 2500 | 0.992 | ··· | 0.991 | ··· | 0.988 | ··· | 0.978 | ··· | 0.968 |

CORRECTION COEFFICIENT $\alpha$

FIG. 8A

70a

| MOTOR SPEED V | DIFFERENCE IN SPEED dV | FIRST CORRECTION VALUE TL1 |
|---|---|---|
| RATED SPEED +10% | 0.10 | $0.10\times\beta$ |
| RATED SPEED +5% | 0.05 | $0.05\times\beta$ |
| RATED SPEED | 0 | 0 |
| RATED SPEED −5% | −0.05 | $-0.05\times\beta$ |
| RATED SPEED −10% | −0.10 | $-0.10\times\beta$ |
| ... | ... | ... |
| LOWER LIMIT SPEED | −0.50 | $-0.50\times\beta$ |

FIG. 8B

70b

| MEASURED CURRENT VALUE Im | DIFFERENCE IN CURRENT dI | SECOND CORRECTION VALUE TL2 |
|---|---|---|
| RATED CURRENT | 0 | $\gamma 1$ |
| RATED CURRENT −5% | 0.05 | $0.05\times\gamma 1$ |
| RATED CURRENT −10% | 0.10 | $0.10\times\gamma 1$ |

FIG. 8C

70c

| MEASURED CURRENT VALUE Im | DIFFERENCE IN CURRENT dI | SECOND CORRECTION VALUE TL2 |
|---|---|---|
| RATED CURRENT | 0 | $\gamma 2$ |
| RATED CURRENT −5% | 0.05 | $(0.05)^n\times\gamma 2$ |
| RATED CURRENT −10% | 0.10 | $(0.10)^n\times\gamma 2$ |

(n IS INTEGER OF 2 OR MORE)

IMAGE FORMING APPARATUS

The entire disclosure of Japanese patent Application No. 2018-165745, filed on Sep. 5, 2018, is incorporated herein by reference in its entirety.

BACKGROUND

Technological Field

The present invention relates to an image forming apparatus.

Description of the Related Art

An image forming apparatus, such as a printer, a copier, or a multi-function peripheral, includes various rotators, such as rollers for conveyance of sheets, and motors that drive the rotators. For this type of image forming apparatus, measurement of torque generated by a motor, and control of the operation of the image forming apparatus and determination of the state of a rotator, based on a measured result, have been known.

JP 2017-58640 A discloses detection of current flowing through a motor used for conveyance of recording paper as the torque of the motor, detection of the type of recording paper based on the torque, and change of conveyance speed to a speed suitable to the detected type in a case where the detected type is different from the set type.

JP 2016-33582 A discloses detection of the load torque of a motor for conveyance, and, in a case where the load torque exceeds output torque, control of current supplied to the motor for reduction of the number of revolutions, resulting in inhibition of the motor from heating.

JP 2014-2233 A discloses, for an electrophotographic image forming apparatus, formation of an image a plurality of times with change of the temperature of a photoreceptor, measurement of the torque of a motor driving the photoreceptor with a torque sensor during the formation, and determination of the deterioration state of the photoreceptor based on a variation in the torque.

In a case where a torque sensor is used to measure torque as in the technology in JP 2014-2233 A, because a space for arrangement of the torque sensor must be allowed, an image forming apparatus has difficulty in being downsized. In addition, there is a problem that a rise occurs in component cost.

Such a problem can be solved by measurement of motor current as torque as in the technology in JP 2017-58640 A.

However, there is a problem that a non-negligible difference occurs between a torque value (theoretical value) acquired by conversion of multiplying a measured value of the motor current by a motor constant Kt unique to a motor and a torque value (actual measured value) measured with a torque sensor.

In recent years, continuous use of a replaceable component until the life thereof and replacement of the replaceable component just before the life have been more important to an image forming apparatus. For continuous use of a replaceable component until the end of its life, it is required to accurately predict the life varying depending on the usage condition of an image forming apparatus. Thus, for life prediction based on a variation in the torque of a motor, improvement of the accuracy in measuring the torque is required.

SUMMARY

The present invention has been made in consideration of the problem, and an object of the present invention is to provide an image forming apparatus enabling acquisition of a more accurate torque value than ever before, with no torque sensor.

To achieve the abovementioned object, according to an aspect of the present invention, an image forming apparatus reflecting one aspect of the present invention comprises: a rotator used to form the image; a motor that drives the rotator rotationally; a current measurer that measures motor current flowing through a current-carrying path including a winding of the motor, at measurement timing that is timing after the motor starts up; a torque acquirer that acquires a torque value of the motor based on a measured value of the motor current; and a corrector that performs correction for cancellation of an amount of error based on one or both of a variation in characteristic corresponding to motor speed of the motor and a variation in characteristic corresponding to the motor current at the measurement timing, at the acquisition of the torque value by the torque acquirer.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention:

FIGS. 8A to 8C are tables of other examples of correction information;

DETAILED DESCRIPTION OF EMBODIMENTS

Hereinafter, one or more embodiments of the present invention will be described with reference to the drawings. However, the scope of the invention is not limited to the disclosed embodiments.

Figure 1:
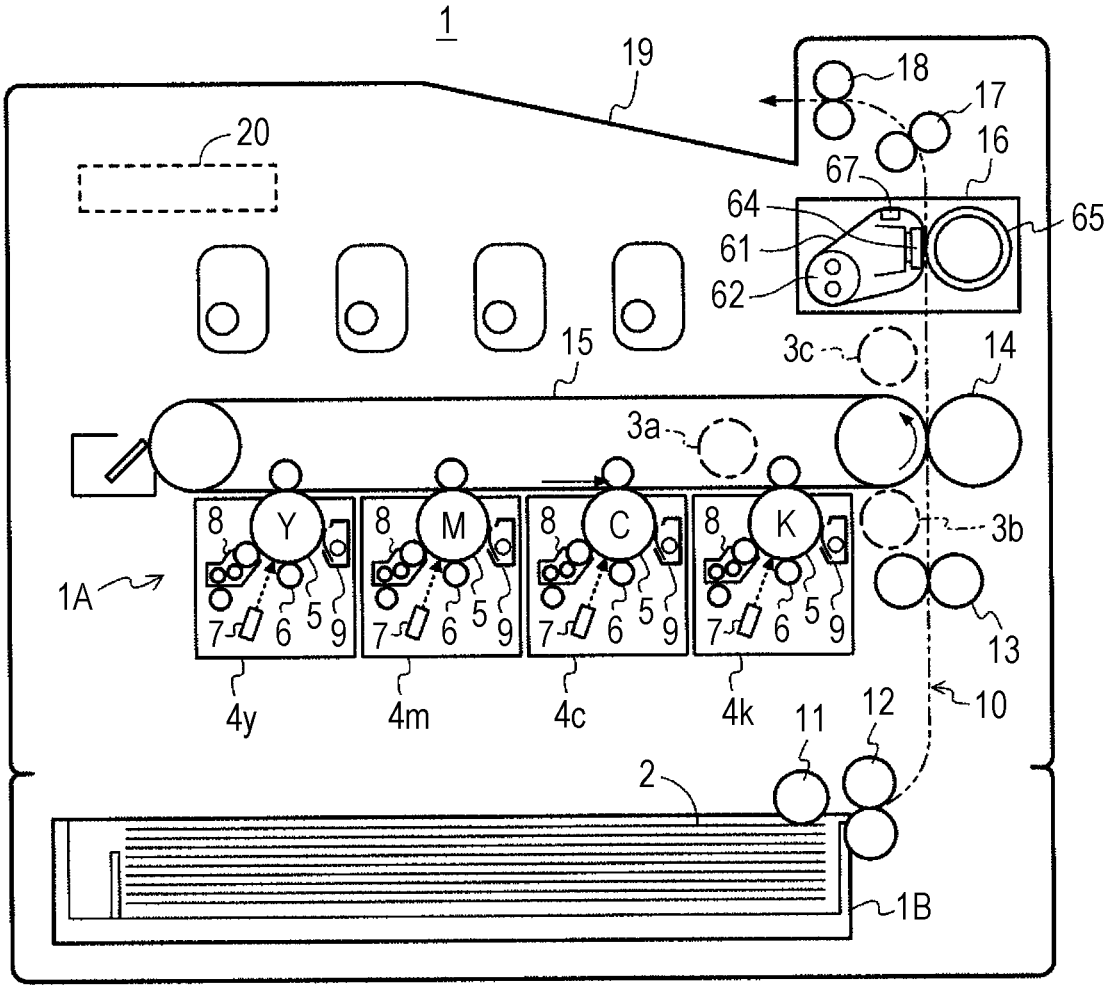
FIG. 1 is a view of the schematic configuration of an image forming apparatus according to an embodiment of the present invention.
Figure 2:
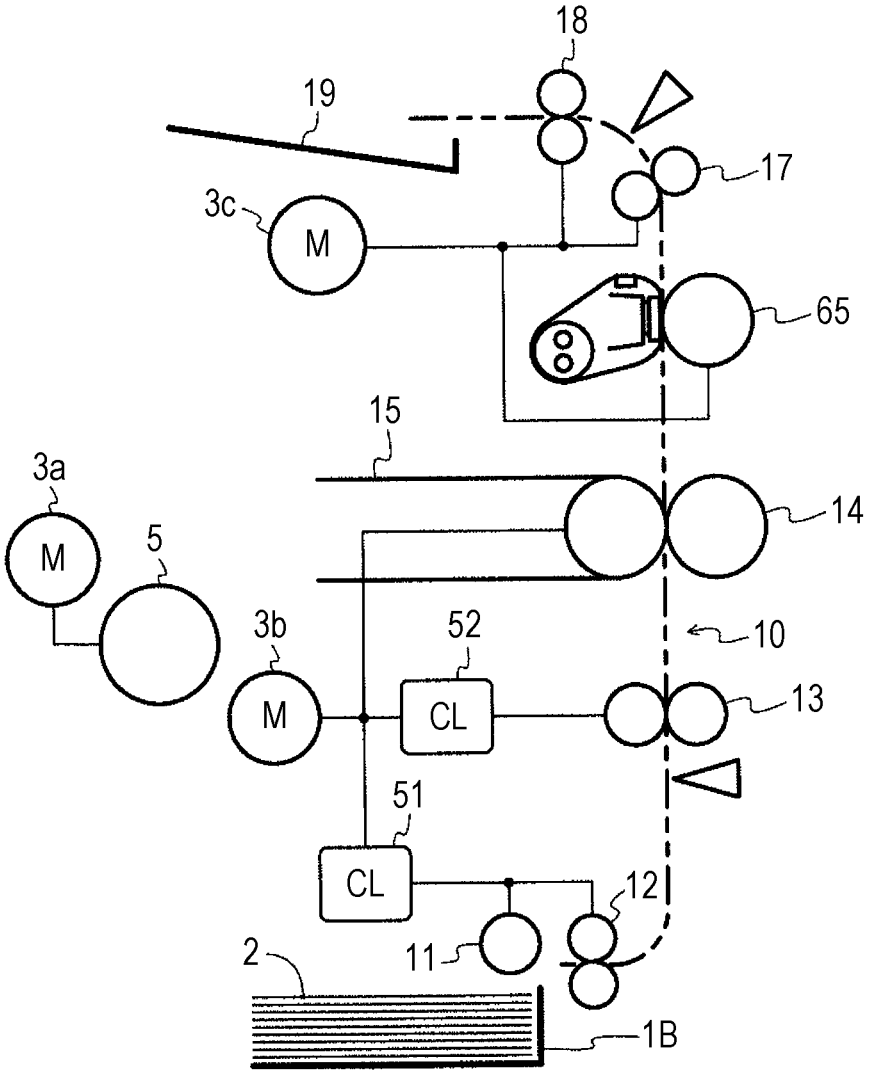
FIG. 2 is a view of respective drive targets of a plurality of motors.

FIG. 1 illustrates the schematic configuration of an image forming apparatus 1 according to an embodiment of the present invention. FIG. 2 illustrates respective drive targets of a plurality of motors 3*a*, 3*b*, and 3*c*.

Referring to FIG. 1, the image forming apparatus 1 is a color printer including an electrophotographic printer engine 1A. The image forming apparatus 1 forms a color image or a monochrome image in accordance with a job input from an external host device through a network. The image forming apparatus 1 includes a control circuit 20 that controls the operation thereof. The control circuit 20 includes a processor that executes a control program, and peripheral devices (e.g., a ROM and a RAM).

The printer engine 1A includes four imaging stations 4*y*, 4*m*, 4*c*, and 4*k* arrayed horizontally. Each of the imaging stations 4*y* to 4*k* includes a tubular photoreceptor 5, a charging roller 6, a print head 7, a developer 8, and a cleaner 9.

In color print mode, the four imaging stations 4*y* to 4*k* form four colors of toner images in yellow (Y), magenta (M), cyan (C), and block (K) in parallel. The four colors of toner images are sequentially primary-transferred to an intermediate transfer belt 15 rotating. The toner image in Y is first transferred, and then the toner image in M, the toner image in C, and the toner image in K are sequentially transferred so as to be superimposed on the toner image in Y.

In opposition to a secondary transfer roller 14, the primary-transferred toner images are secondary-transferred to a sheet (recording sheet) 2 fed and conveyed from a paper cassette 1B below. After the secondary transfer, the sheet 2 is ejected to an upper ejection tray 19 through the inside of a pad-type fixer 16. During the passage through the fixer 16, the toner images are fixed to the sheet 2 by heating and pressing.

The fixer 16 includes a fixing belt 61, a heating roller 62, a pad 64, and a pressing roller 65.

The fixing belt 61 including a barrel-shaped fixing member having flexibility, is provided so as to rotate around the heating roller 62 and the pad 64 in contact with the heating roller 62 and the pad 64. The heating roller 62 heats due to a fixing heater built in the heating roller 62, and then heats the fixing belt 61 in contact with the circumferential face of the heating roller 62.

The pad 64 is secured to a stay, opposite the pressing roller 65 through the fixing belt 61. The pressing roller 65 including a tubular cored bar and an elastic object covering the circumference of the cored bar, is supported movably in the radial direction so as to adjust press force to the pad 64.

At the fixing during the passage of the sheet 2 through the inside of the fixer 16, the pressing roller 65 rotates while pressing the sheet 2 against the pad 64. At this time, the elastic object of the pressing roller 65 deforms along the pad 64, resulting in formation of a fixing nip having a predetermined length for a press to the sheet 2. The rotation of the pressing roller 65 causes movement of the sheet 2, and then the fixing belt 61 is drawn by the sheet 2 so as to rotate.

During the rotation of the fixing belt 61, the fixing belt 61 slides on the pad 64. In order to reduce sliding resistance, a layer of lubricant is provided between the fixing belt 61 and the pad 64. The fixer 16 includes a lubricant container 67 from which the lubricant is supplied onto the inner face of the fixing belt 61.

Referring to FIG. 2, a pickup roller 11, a pair of paper-feeding rollers 12, a pair of registration rollers 13, a secondary transfer roller 14, the pressing roller 65 for fixing, and pairs of paper-ejecting rollers 17 and 18 are disposed in this order from the upstream side, at a conveyance path 10 for sheets 2 inside the image forming apparatus 1. Rotation of the rollers causes a sheet 2 to be conveyed.

The image forming apparatus 1 includes the plurality of motors 3*a*, 3*b*, and 3*c* as rotary drive sources. The motor 3*a* is mainly used as a photoreceptor motor that drives the photoreceptor 5 of the imaging station 4*k*. The motor 3*b* is a drive source common between the pickup roller 11, the pair of paper-feeding rollers 12, the pair of registration rollers 13, the secondary transfer roller 14, and the intermediate transfer belt 15. The motor 3*c* is a drive source common between the pressing roller 65 and the pairs of paper-ejecting rollers 17 and 18.

The rotary driving force of the motor 3*b* is transmitted to the pickup roller 11 and the pair of paper-feeding rollers 12 through a clutch 51 and to the pair of registration rollers 13 through a clutch 52. Turning the clutches 51 and 52 on and off allows control between rotation and stopping of the rollers to be independent of drive control of the secondary transfer roller 14.

In some cases, a "motor 3" is given below with no distinction between the motors 3*a* to 3*c*.

Note that the image forming apparatus 1 includes a plurality of motors in addition to the motors 3*a* to 3*c*. For example, provided are a developer motor that drives rollers in the developers 8 of the imaging stations 4*y* to 4*k*, and a toner-replenishment motor that drives a mechanism of replenishing toner from toner bottles to the developers 8.

The combination between a motor 3 and a rotator as a drive target is not limited to the example of FIG. 2. One motor 3 may drive a plurality of rotators, or may drive only one rotator. For example, provided may be a motor 3 dedicated to the pressing roller 65 of the fixer 16.

The motor 3 is a DC brushless motor, namely, a permanent magnet synchronous motor (PMSM) in which a rotor using a permanent magnet rotates. A stator in the motor 3 includes a U-phase core, a V-phase core, and a W-phase core disposed at electrical angles of 120°, and three windings (coils), for example, in Y connection. The cores are excited in sequence with supply of three-phase alternating current having a U phase, a V phase, and a W phase to the windings, so that a rotating magnetic field occurs. The rotor rotates in synchronization with the rotating magnetic field.

The number of magnetic poles in the rotor may be two, four, six, eight, ten, or more. The rotor may be an outer rotor or an inner rotor. The number of slots in the stator may be three, six, nine, or more.

In any case, vector control of determining the direction and the level of the magnetic flux of the rotating magnetic field, is performed to the motor 3 with a control model based on a d-q coordinate system. In the vector control to the motor 3, the three-phase alternating current flowing through the windings of the motor 3 is converted into direct current to be supplied to the windings corresponding to two phases rotating in synchronization with the rotor, resulting in simplification in control.

The image forming apparatus 1 has a function of measuring (detecting) torque T generated by the motor 3, namely, a function of acquiring a torque value DT as a measured value. The image forming apparatus 1 determines the state of each type of rotator that is the drive target of the motor 3, on the basis of the acquired torque value DT. The state of the rotator includes the state of variation in age due to abrasion, alteration, or contamination, and the state of contact with a different member, such as cling or twining of a sheet 2 or burrs of a blade for cleaning. The determination of the state of the rotator includes life prediction of the rotator.

The configuration and the operation of the image forming apparatus 1 will be described below, focusing on the function of acquiring a torque value DT.

Figure 3:
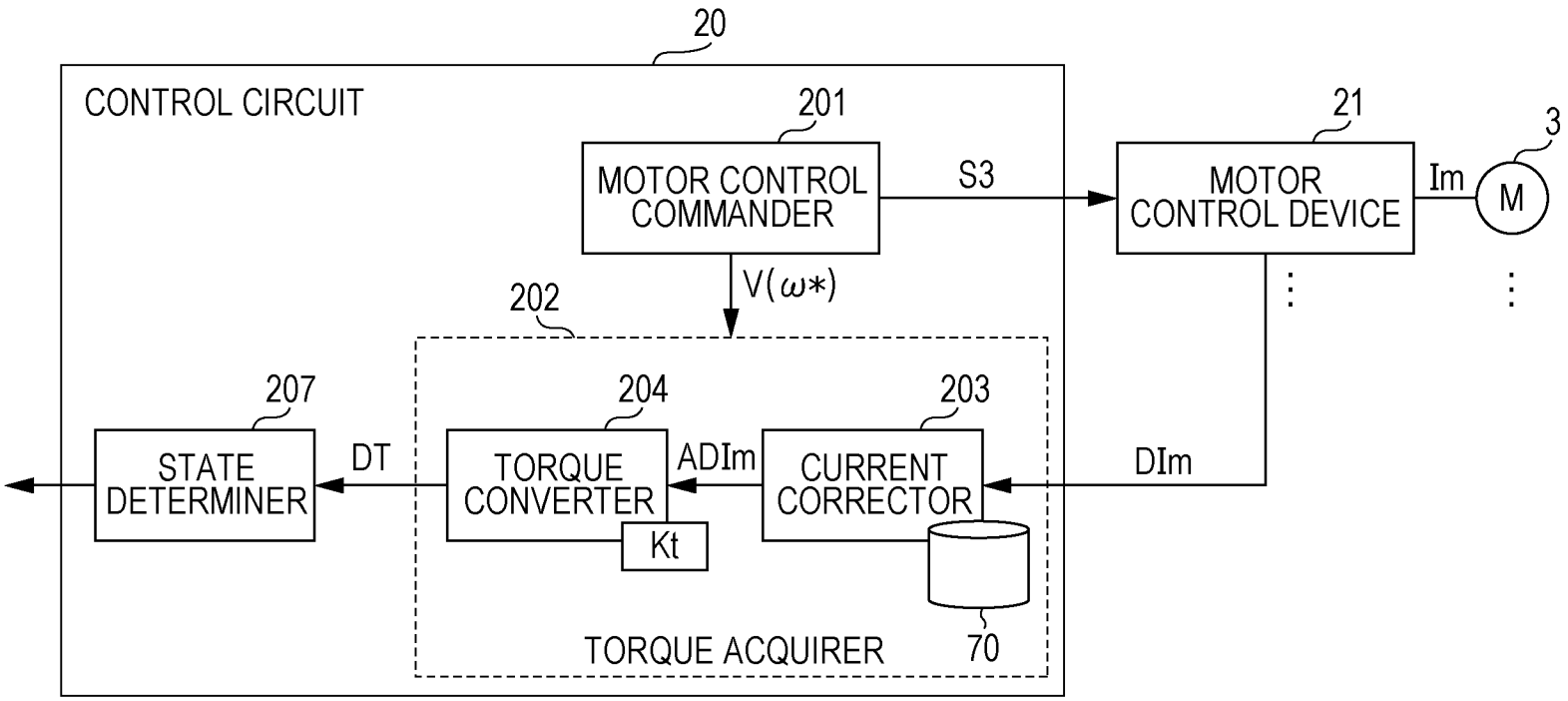
FIG. 3 is a diagram of an exemplary functional configuration of main constituents of a control circuit.

FIG. 3 illustrates an exemplary functional configuration of main constituents of the control circuit 20.

The control circuit 20 includes a motor control commander 201, a torque acquirer 202, and a state determiner 207. The torque acquirer 202 includes a current corrector 203 and a torque converter 204. The functions thereof are achieved by a hardware configuration of the control circuit 20, by execution of the control program by the CPU, or by a combination thereof.

The motor control commander 201 gives a control signal S3 to a motor control device 21 that controls the motor 3. The motor control device 21 is provided to each of the motors 3*a* to 3*c*. An individual control signal S3 is given to each of the motor control devices 21 identical in number to the motors 3*a* to 3*c*.

The rotators driven by the motors 3*a* to 3*c* are respectively required to rotate at a constant speed in image forming. More specifically, the photoreceptor 5 is required to rotate at a constant speed at least from the start of formation of an electrostatic latent image to the completion of primary transferring of a toner image, and the intermediate transfer belt 15 is required to rotate at a constant speed at least from the start of the first primary transferring to the completion of secondary transferring. The pressing roller 65 is required to rotate at a constant speed at least during passage of a sheet 2 through the fixer 16.

Thus, the motor control commander 201 issues a command for start-up to the motor 3 on a timely basis, such that the rotation is stabilized before the timing for constant-speed rotation. An operation pattern applied to the motor 3 is an adjustable-speed pattern in which so-called trapezoidal drive is basically performed. That is the motor 3 is driven from halt condition and accelerates up to a target speed. The motor 3 retains the target speed for a predetermined time, and then decelerates and halts.

Note that the target speed is switched in accordance with process speed. The process speed is an image forming condition in which, for example, the rotational speed of a photoreceptor and the conveyance speed of a sheet 2 are prescribed. For example, the process speed is lower in a case where thick paper is used as a sheet 2 than in a case where plain paper is used. That is the target speed of the motor 3 (motor speed V) is reduced. This arrangement causes the time of passage of a sheet 2 through the fixer 16 to lengthen. Thus, the sheet 2 is sufficiently heated, so that favorable toner-image fixing can be achieved.

The torque acquirer 202 acquires the torque value DT of the motor 3, on the basis of a measured current value DIm input from the motor control device 21. The measured current value DIm is a measured value of motor current Im flowing through a current-carrying path including the windings of the motor 3.

At the acquisition of the torque value DT in the torque acquirer 202, the current corrector 203 performs correction for cancellation of the amount of error based on a variation in characteristic corresponding to the motor speed V of the motor 3 and a variation in characteristic corresponding to the motor current Im at the measurement timing of the motor current Im. Specifically, on the basis of correction information 70 indicating, as the amount of error, the amount of loss current corresponding to the motor current Im for each of a plurality of values of the motor speed V, the current corrector 203 corrects the measured current value DIm such that the amount of loss current included in the measured current value DIm is removed. Then, the current corrector 203 outputs a corrected measured current value ADIm. The correction of the current corrector 203 will be described later.

The torque converter 204 performs torque conversion of multiplying the corrected measured current value ADIm from the current corrector 203 by a motor constant Kt unique to the motor 3, to acquire the torque value DT.

The state determiner 207 determines the state of the rotator driven by the motor 3, on the basis of the torque value DT calculated by the torque acquirer 202. The life of the rotator is predicted, on the basis of the torque value DT.

Figure 4A:
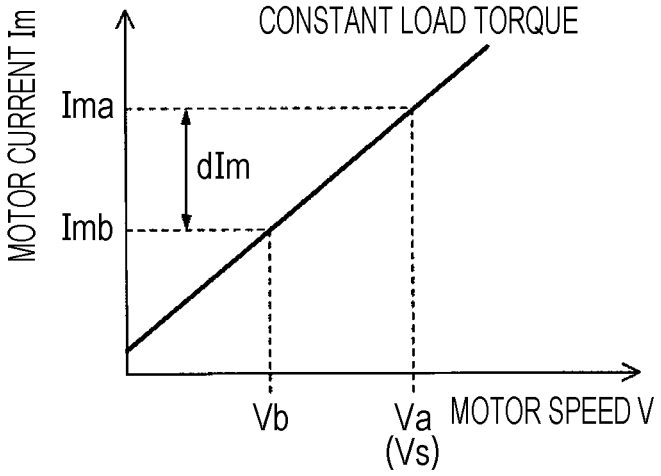
FIG. 4A is a graph of the relationship between motor speed and motor current.
Figure 4B:
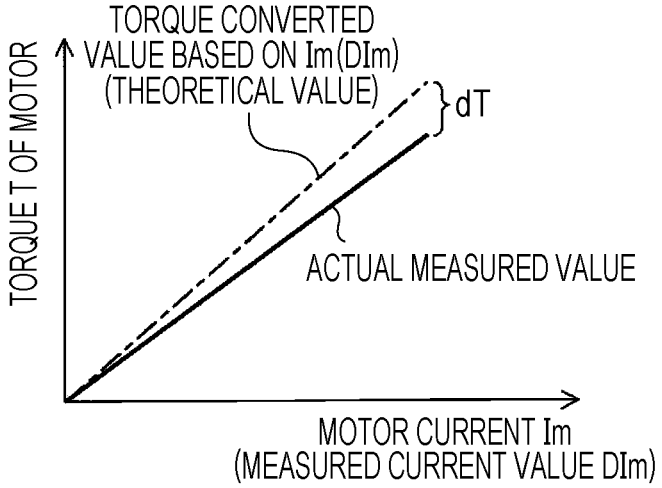
FIG. 4B is a graph of the relationship between motor current and the torque of a motor.
Figures 5A, 5B:
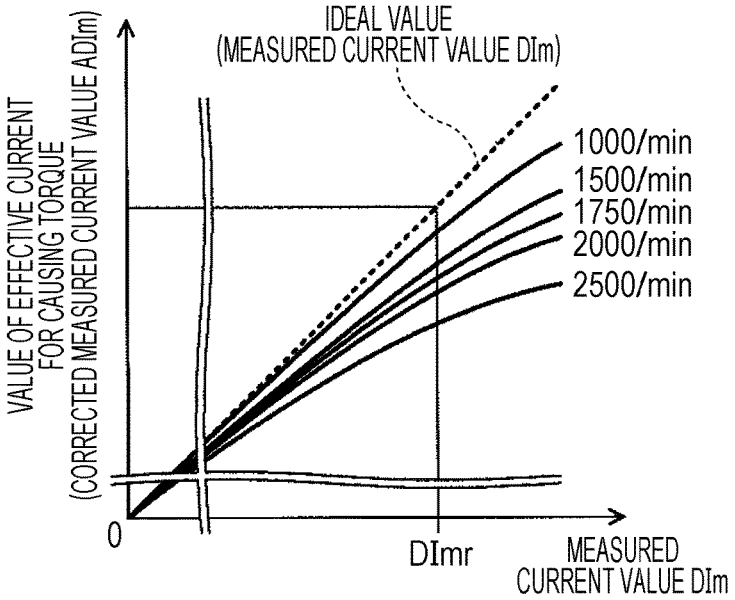
FIG. 5A is a graph of the relationship between a measured current value and the value of current for causing torque.
FIG. 5B is a table of an example of correction information.

FIGS. 4A and 4B indicate the relationship between the motor speed V and the motor current Im and the relationship between the motor current Im and the torque (output torque) T of the motor 3, respectively. FIGS. 5A and 5B indicate the relationship between the measured current value DIm and the value of current for causing torque and an example of the correction information 70, respectively.

As indicated in FIG. 4A, the motor current Im depends on the motor speed V. That is, when the motor 3 retains the rotator, in constant-speed rotation, coupled thereto through a transmission system, the motor current Im is increased as the motor speed V is larger.

As described above, because the motor speed V is switched in accordance with setting of the process speed in the image forming apparatus 1, in some cases, the dependence of the motor current Im on the motor speed V causes a problem.

For example, every elapse of a predetermined number of days or every time the cumulative number of printed sheets increases by a predetermined number of sheets, the life of the rotator is predicted, on the basis of a variation from the previous current torque value DT. In this case, a condition is likely to occur in which the previous motor speed V is Va and the current motor speed V is Vb at measurement of the motor current Im for acquisition of the torque value DT at prediction.

Under the condition, the difference dim between motor current Ima corresponding to the motor speed Va and motor current Imb corresponding to the motor speed Vb does not mean the amount of variation in age of the rotator. That is, even when the motor currents Ima and Imb, of which the corresponding motor speeds V are different from each other, are directly converted into torques T and then the torques T are compared, the life of the rotator cannot be predicted correctly.

Thus, in accordance with the motor speed V at measurement of the motor current Im, the current corrector 203 corrects the measured current value DIm such that the torque value DT available for lift prediction is acquired, similarly to a case where the motor speed V is not switched.

As indicated in FIG. 4B, the value of the torque T actually measured with a torque sensor attached to the motor 3 (actual measured value), is smaller than a torque converted value (theoretical value) acquired by multiplying the motor current Im (measured current value DIm) by the torque constant Kt. This means that, because part of the motor current Im is loss current that does not contribute to generation of the torque T, the torque converted value based on the measured current value DIm includes the amount of loss current (loss torque) dT.

The amount of loss current dT depends on the level of the motor current Im. Therefore, if the measured current value DIm is uniformly corrected in accordance with only the motor speed V without consideration of the level of the motor current Im, an error remains in the torque value DT acquired from the corrected measured current value ADIm.

Thus, the current corrector 203 corrects the measured current value DIm with the amount of correction corresponding to the motor speed V at measurement of the motor current Im and the measured current value DIm measured.

FIG. 5A indicates the result of an experiment in which the difference between the value directly converted in torque from the measured current value DIm and the value of the torque T actually measured with the torque sensor is obtained and then the value of effective current for causing torque is calculated from the measured current value DIm, on the basis of the obtained difference. Because of the experiment with the motor speed V being switched, referring to FIG. 5A, the relationship between the measured current value DIm and the value of effective current at a plurality of different values of the motor speed V is indicated with solid lines.

According to the example of FIG. 5A, the ratio of the value of effective current to the measured current value DIm (ideal value) indicated with a broken line, decreases as the measured current value DIm increases. In other words, as the measured current value DIm increases, the loss current increases.

FIG. 5B is a table of the correction information 70 indicating a correction coefficient α determined on the basis of the relationship of FIG. 5A. The correction coefficient α is associated with the measured current value DIm at the plurality of values of the motor speed V. In the correction information 70, the level of the measured current value DIm is expressed by rated current ratio with, as 100%, a measured current value DImr corresponding to the rated current in the specifications of the motor 3 (percentage of DIm to DImr).

For example, in a case where the motor speed V is 1000/min (1000 rpm), the measured current value DIm at 80% of the measured current value DImr, is associated with 0.992 as the correction coefficient α.

Referring to FIG. 3, the current corrector 203 extracts the correction coefficient α corresponding to the motor speed V notified from the motor control commander 201 and the measured current value DIm from the motor control device 21, from the correction information 70. Then, the current corrector 203 performs correction of multiplying the measured current value DIm by the extracted correction coefficient α. The corrected measured current value ADIm is expressed by the following Expression (1):

$$ADIm=\alpha\times DIm \tag{1}$$

Therefore, the torque value DT calculated by the torque converter 204 is expressed by the following Expression (2):

$$DT=Kt\times ADIm=Kt\times\alpha\times DIm \tag{2}$$

The correction of the measured current value DIm with the correction coefficient α allows acquisition of the torque value DT excluding the amount of error corresponding to the motor speed V and the amount of error corresponding to the motor current Im (amount of loss current dT).

Note that the method of acquiring the torque value DT is not limited to a method with the correction information 70 in a lookup table, and thus the torque value DT may be acquired by computing with an approximate arithmetic expression for the relationship of FIG. 5A stored as the correction information 70. For the lookup table method, a method of estimating a value absent from the table with an interpolation technique can be used together.

Figure 6:
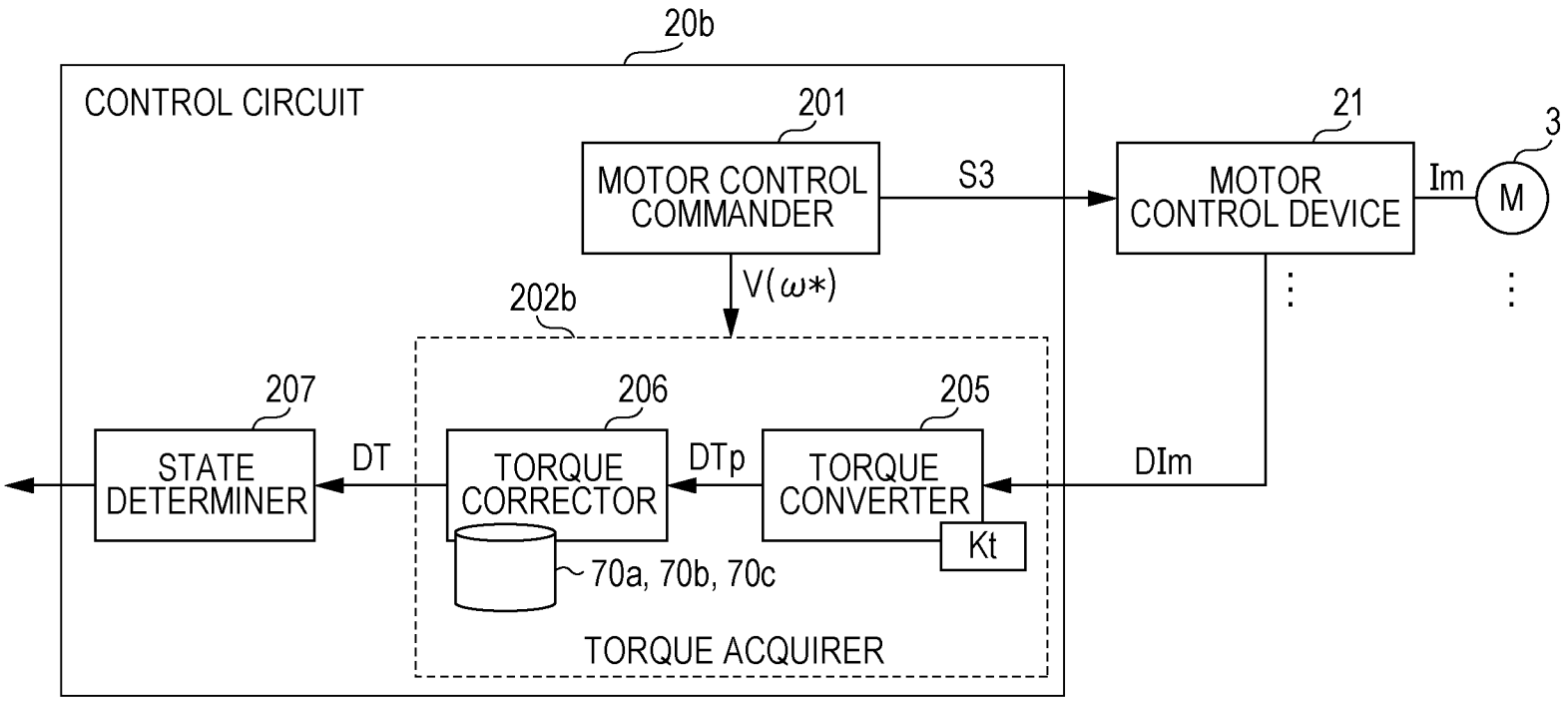
FIG. 6 is a diagram of a modification of the functional configuration of the control circuit.
Figure 7A:
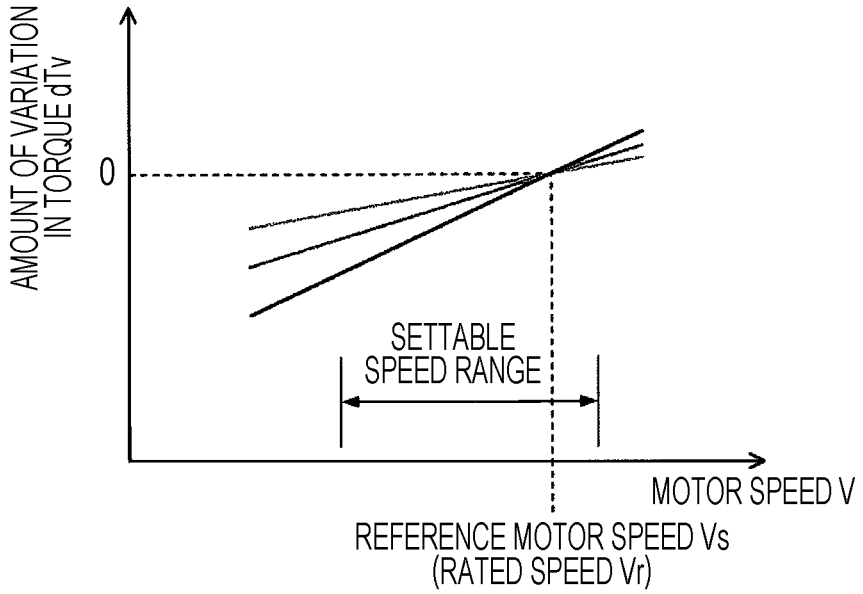
FIG. 7A is a graph of exemplary relationship between motor speed and the amount of variation in torque with respect to torque at reference motor speed.
Figure 7B:
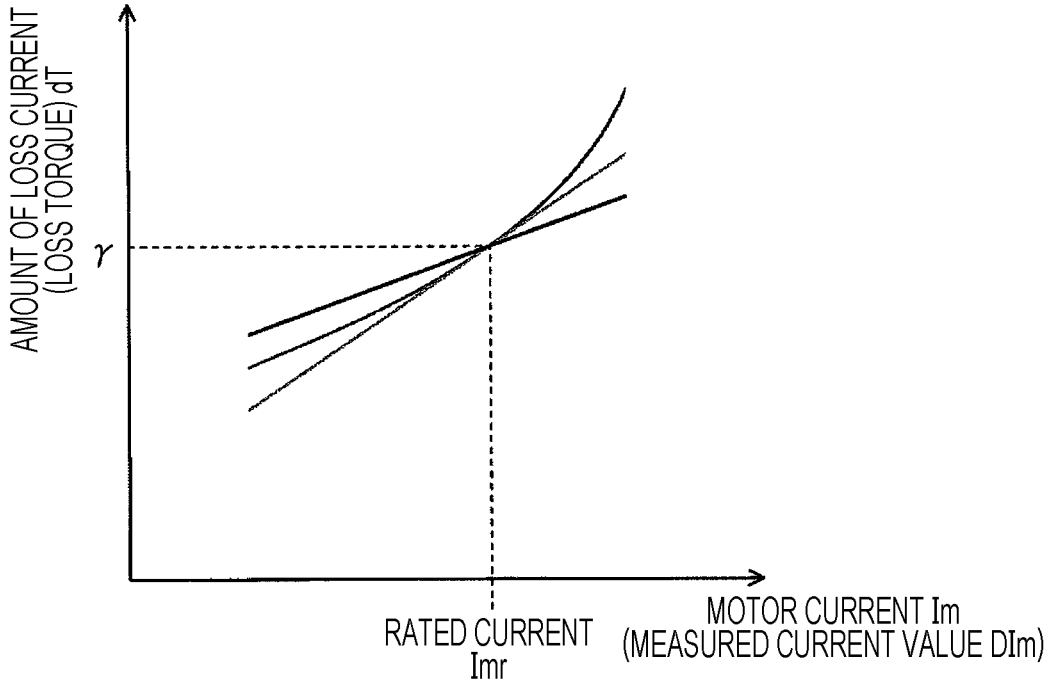
FIG. 7B is a graph of exemplary relationship between motor current and the amount of loss current.

FIG. 6 illustrates a modification of the functional configuration of the control circuit 20. FIGS. 7A and 7B indicate exemplary relationship between motor speed V and the amount of variation in torque dTv with respect to torque T at reference motor speed Vs and exemplary relationship between motor current Im and the amount of loss current dT, respectively. FIGS. 8A to 8C indicate other examples of the correction information 70.

A control circuit 20*b* in the example of FIG. 6 includes a motor control commander 201, a torque acquirer 202*b*, and a state determiner 207. The respective functions of the motor control commander 201 and the state determiner 207 are similar to those in the control circuit 20 of FIG. 3.

The torque acquirer 202*b* including a torque converter 205 and a torque corrector 206, acquires the torque value DT of the motor 3, on the basis of the measured current value DIm input from the motor control device 21, similarly to the torque acquirer 202*b* of FIG. 3.

Note that the torque acquirer 202*b* does not correct the measured current value DIm but corrects a provisional torque value DTp to acquire the torque value DT. That is the torque converter 205 performs torque conversion to the measured current value DIm from the motor control device 21, with a motor constant Kt, to acquire the provisional torque value DTp. Then, the torque corrector 206 performs correction for cancellation of the amount of loss current dT to the provisional torque value DTp, to acquire the torque value DT.

The provisional torque value DTp is expressed by the following Expression (3):

$$DTp=Kt\times DIm \tag{3}$$

For example, the torque corrector 206 calculates the torque value DT by computing based on the following Expression (4):

$$DT=DTp-TL1-TL2 \tag{4}$$

In Expression (4), TL1 represents a first correction value for correction of the amount of error corresponding to the motor speed V, and TL2 represents a second correction value for correction of the amount of error corresponding to the level of the motor current Im.

The first correction value TL1 is selected on the basis of the result of an experiment in which the relationship between the motor speed V and the amount of variation in torque dTv indicated in FIG. 7A is obtained. The amount of variation in torque dTv is the difference between the provisional torque value DTp calculated on the basis of the measured current value DIm at the motor speed V having an arbitrary value in a settable range and a reference torque value DTs (namely, dTv=DTp−DTs). The reference torque value DTs is the provisional torque value DTp calculated on the basis of the measured current value DIm at the motor speed V that is the reference motor speed Vs (rated speed Vr in the present embodiment).

Generally, the amount of variation in torque dTv increases at substantially constant ratio as the motor speed V increases. Note that the ratio depends on the specifications of the motor 3. In a case where a plurality of motors 3 different in model number is used, the first correction value TL1 must be selected, in advance.

For the correction with the first correction value TL1, in a case where the motor speed V at measurement of the motor current Im is slower than the reference motor speed Vs, the torque value DT is larger than the provisional torque value DTp. Conversely, in a case where the motor speed V at measurement of the motor current Im is faster than the reference motor speed Vs, the torque value DT is smaller than the provisional torque value DTp.

The torque corrector 206 extracts the first correction value TL1 corresponding to the motor speed V notified from the motor control commander 201, from correction information 70*a*, and substitutes the extracted first correction value TL1 into Expression (4) to perform the correction.

As indicated in FIG. 8A, in the correction information 70*a*, the absolute value of the first correction value TL1 is a value acquired by multiplying the difference in speed dV (dV=V−Vs) between the motor speed V and the reference motor speed Vs, by a correction coefficient β. The correction coefficient β is selected along the relationship between the motor speed V and the amount of variation in torque dTv, depending on the specifications of the motor 3 and an individual difference (refer to FIG. 7A).

The absolute value of the first correction value TL1 is allowed to be a value acquired by multiplying the m power of the difference in speed dV (m is an integer of one or more) by the correction coefficient β. According to the example of FIG. 8A, m is 1.

The second correction value TL2 is selected on the basis of the result of an experiment in which the relationship between the motor current Im (measured current value DIm) and the amount of loss current dT in the torque T indicated in FIG. 7B is obtained.

Generally, the amount of loss current dT increases as the motor current Im increases. Note that the rate of the increase is substantially constant or increases exponentially, depending on the specifications of the operating characteristic of the motor 3 and an individual difference. The second correction value TL2 must be selected, in advance, in accordance with the motor 3 for use.

For the correction with the second correction value TL2, the torque value DT is smaller by the second correction value TL2 than the provisional torque value DTp.

Because the provisional torque value DTp input into the torque corrector 206 is a value acquired by multiplying the measured current value DIm by the torque constant Kt, the provisional torque value DTp uniquely indicates the measured current value DIm. The torque corrector 206 extracts the second correction value TL2 corresponding to the input provisional torque value DTp, from correction information 70*b* or correction information 70*c*, and substitutes the extracted second correction value TL2 into Expression (4) to perform the correction. Whether to refer to the correction information 70*b* or the correction information 70*c* is previously set.

As indicated in FIG. 8B, in the correction information 70*b*, the second correction value TL2 at the measured current value DIm that is a rated current value DImr, is a correction coefficient γ1. The second correction value TL2 at the measured current value DIm that is not the rated current value DImr, is a value acquired by multiplying the difference in current dI (dI=|DIm−DImr|) between the measured current value DIm and the rated current value DImr, by the correction coefficient γ1. The second correction value TL2 can be regarded as a value acquired by multiplying the m power of the difference in current dI (m is one) by the correction coefficient γ1.

The correction coefficient γ1 is selected along the relationship between the motor current Im and the amount of loss current dT in the motor 3 for use (refer to FIG. 7B).

As indicated in FIG. 8C, in the correction information 70*c*, the second correction value TL2 at the measured current value DIm that is the rated current value DImr, is a correction coefficient γ2. The second correction value TL2 at the measured current value DIm that is not the rated current value DImr, is a value acquired by multiplying the n power of the difference in current dI (n is an integer of two or more) between the measured current value DIm and the rated current value DImr, by the correction coefficient γ2. The power n and the correction coefficient γ2 are selected along the relationship between the motor current Im and the amount of loss current dT in the motor 3 for use (refer to FIG. 7B).

Figure 9:
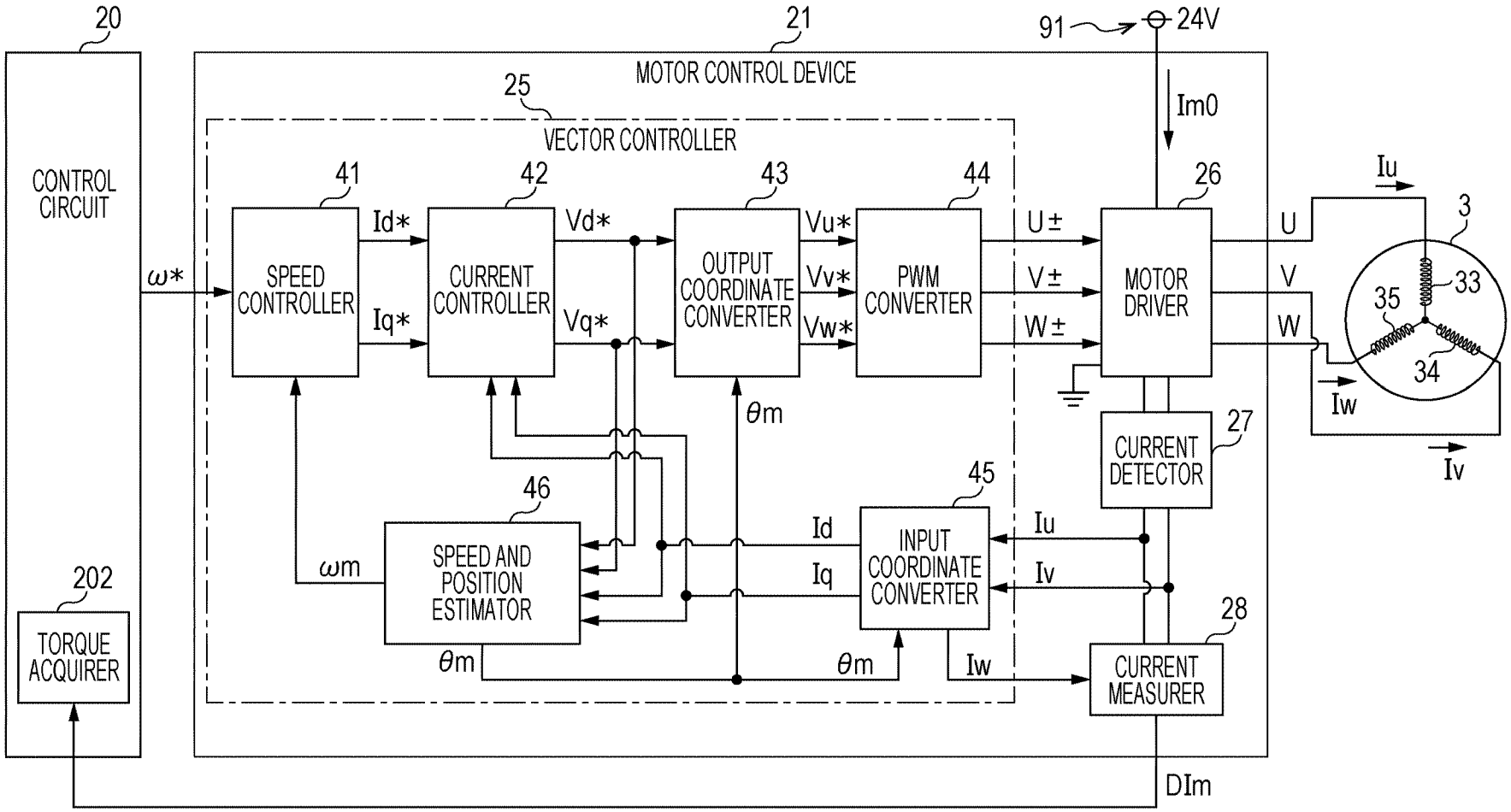
FIG. 9 is a diagram of the functional configuration of a motor control device.
Figure 10:
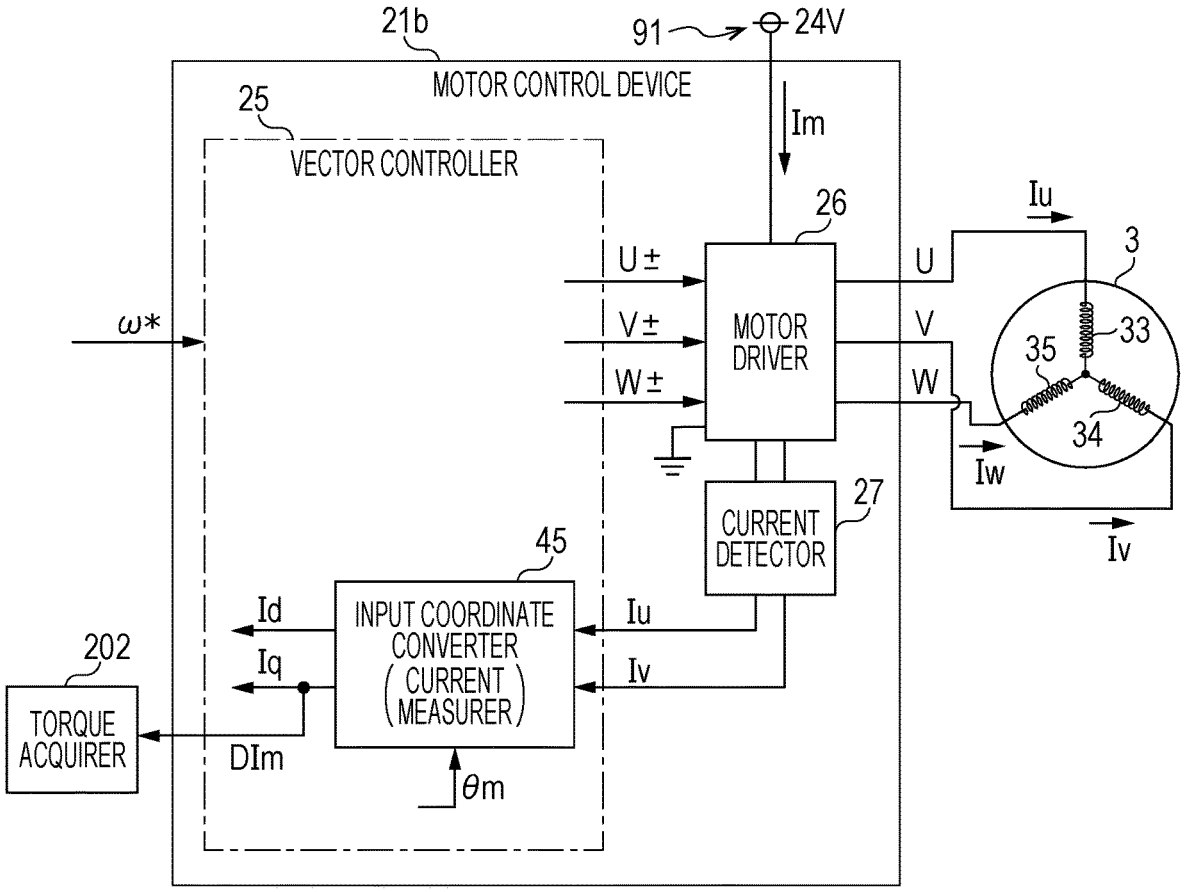
FIG. 10 is a diagram of another example of the functional configuration of the motor control device.

FIG. 9 illustrates the functional configuration of the motor control device 21. FIG. 10 illustrates another example of the functional configuration of the motor control device 21.

The motor 3 is driven and subjected to sensorless vector control by the motor control device 21. In the vector control, proportional-integral-derivative (PID) control is performed in which the rotational speed (ωm) of the motor 3 is fed back so as to correspond to target speed ω*.

The motor control device 21 includes a motor driver 26 that supplies power to the motor 3, a vector controller 25 that controls the motor driver 26 to indirectly control the rotation of the motor 3, and a current detector 27 that detects coil current flowing through the windings of the motor 3. The motor control device 21 is provided with a current measurer 28 that outputs the measured current value DIm.

The motor driver 26 is an inverter circuit that supplies current to the windings 33 to 35 of the motor 3 to drive the rotor. The motor driver 26 turns a plurality of transistors on and off in accordance with control signals U+, U−, V+, V−, W+, and W− from the vector controller 25, to control drive current Im0 flowing from a direct-current power-source line 91 to a ground line through the windings 33 to 35. More specifically, the motor driver 26 controls coil current Iu flowing through the winding 33 in accordance with the control signals U+ and U−, controls coil current Iv flowing through the winding 34 in accordance with the control signal V+ and V−, and controls coil current Iw flowing through the winding 35 in accordance with the control signals W+ and W−.

The forward directions of the coil currents Iu, Iv, and Iw allow the coil currents Iu, Iv, and Iw to flow to a Y-connection point through the windings 33 to 35, respectively.

The current detector 27 detects the coil currents Iu and Iv flowing through the windings 33 and 34, respectively. Because the following expressing is satisfied: Iu+Iv+Iw=0, the coil current Iw can be obtained by calculation from the values of the detected coil currents Iu and Iv. Note that a W-phase current detector may be provided.

The current detector 27 performs A/D conversion to signals acquired by voltage drops across shunt resisters inserted in the channels of the coil currents Iu and Iv, and then outputs the signals as the detected values of the coil currents Iu and Iv. That is two-shunt detection is performed. The resistance of each shunt resister has a small value in an order of 1/10Ω.

The vector controller 25 includes a speed controller 41, a current controller 42, an output coordinate converter 43, a PWM converter 44, an input coordinate converter 45, and a speed and position estimator 46. The vector controller 25 is given the target speed (speed command value) ω* for constant-speed rotation of the motor 3 by the control circuit 20 through the control signal S3.

The speed controller 41 performs computing for proportional-integral control (PI control) of causing the difference between the target speed ω* from the control circuit 20 and the estimated speed (rotational speed) ωm from the speed and position estimator 46, to be close to zero, to determine current command values Id* and Iq* in the d-q coordinate system. The estimated speed ωm is input periodically. The speed controller 41 determines the current command values Id* and Iq* every input of the estimated speed ωm.

The current controller 42 performs computing for proportional-integral control of causing the difference between the current command value Id* and an estimated current value (d-axis current value) Id from the input coordinate converter 45, to be close to zero and the difference between the current command value Iq* and an estimated current value (q-axis current value) Iq from the input coordinate converter 45, to be close to zero. Then, the current controller 42 determines voltage command values Vd* and Vq* in the d-q coordinate system.

On the basis of an estimated angle θm from the speed and position estimator 46, the output coordinate converter 43 converts the voltage command values Vd* and Vq* into a U-phase voltage command value Vu*, a V-phase voltage command value Vv*, and a W-phase voltage command value Vw*. That is two phases are converted in voltage into three phases.

On the basis of the voltage command values Vu*, Vv*, and Vw*, the PWM converter 44 generates patterns of the control signals U+, U−, V+, V−, W+, and W− corresponding to the amplitudes of pseudo sinusoidal voltages to be applied across the windings 33 to 35, for output to the motor driver 26. The control signals U+, U−, V+, V−, W+, and W− are used for control of the frequency and the amplitude of three-phase alternating current power to be supplied to the motor 3 with pulse width modulation (PWM).

The input coordinate converter 45 calculates the value of the W-phase coil current Iw from the respective values of the U-phase coil current Iu and the V-phase coil current Iv detected by the current detector 27. Then, on the basis of the estimated angle θm from the speed and position estimator 46 and the values of the coil currents Iu, Iv, and Iw in the three phases, the input coordinate converter 45 calculates the d-axis current value Id and the q-axis current value Iq that are the estimated current values in the d-q coordinate system. That is three phases are converted in current into two phases.

On the basis of the estimated current values Id and Iq from the input coordinate converter 45 and the voltage command values Vd* and Vq* from the current controller 42, the speed and position estimator 46 obtains the estimated speed ωm and the estimated angle θm in accordance with so-called voltage and current equations. The obtained estimated speed ωm is input into the speed controller 41. The obtained estimated angle θm is input into the output coordinate converter 43 and the input coordinate converter 45.

The current measurer 28 acquires the detected values of the coil currents Iu and Iv from the current detector 27, and acquires the value of the coil current Iw from the input coordinate converter 45. Then, the current measurer 28 calculates only the sum in positive value (or the sum in negative value) from the coil currents Iu, Iv, and Iw, and outputs the sum as the measured current value DIm. The three coils currents Iu, Iv, and Iw do not have positive values, simultaneously. At the drive current Im0 that is not zero, only one or two of the coil currents Iu, Iv, and Iw have positive values, and the rest has a negative value or is zero. Therefore, the measured current value DIm corresponds to the drive current Im0.

The following modification is provided for measurement of the motor current Im.

A motor control device 21*b* illustrated in FIG. 10 includes a motor driver 26, a vector controller 25, and a current detector 27, similarly to the motor control device 21 of FIG. 9. However, the motor control device 21*b* includes no current measurer 28, differently from the motor control device 21 of FIG. 9.

The motor control device 21*b* outputs, as a measured current value DIm, a q-axis current value Iq calculated by an input coordinate converter 45 in the vector controller 25. That is, in the motor control device 21*b*, the input coordinate converter 45 serves as a current measurer that measures motor current Im flowing through a current-carrying path including the windings 33 to 35 of the motor 3.

The q-axis current value Iq is calculated as an effective current component value for causing rotary torque, from the motor current Im flowing through the windings 33 to 35. In some cases, the q-axis current value Iq deviates slightly from the actual measured value of the torque T of the motor 3. Therefore, for use of the q-axis current value Iq in torque conversion, as described above, preferably, correction information 70 is created on the basis of an experiment in which the torque T is actually measured, and the torque conversion is performed after correction of the q-axis current value Iq based on the correction information 70.

Figure 11A:
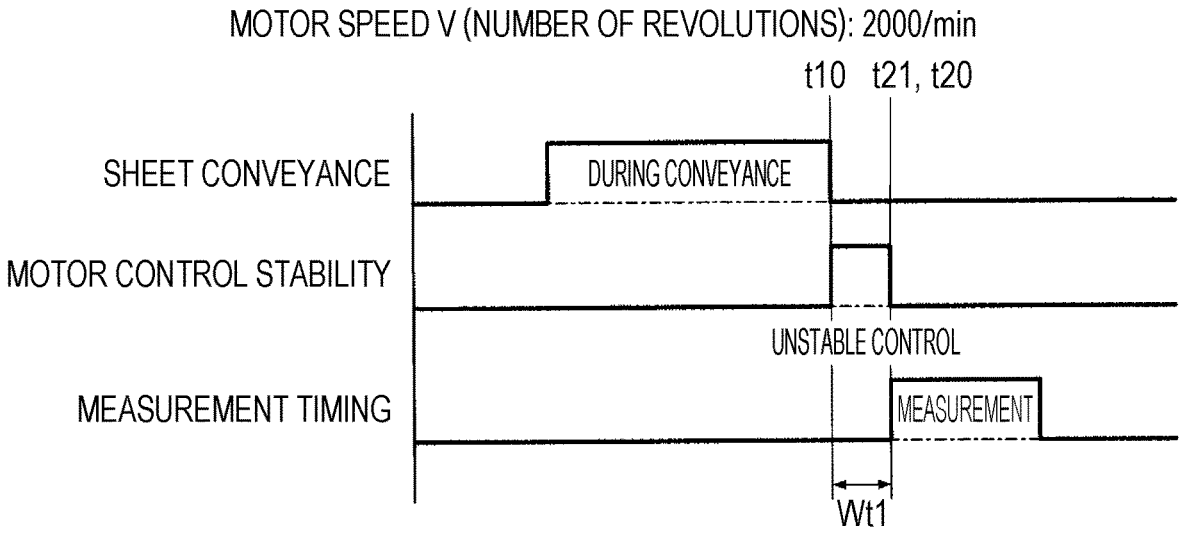
FIGS. 11A and 11B are timing charts of exemplary measurement timing of motor current.
Figure 11B:
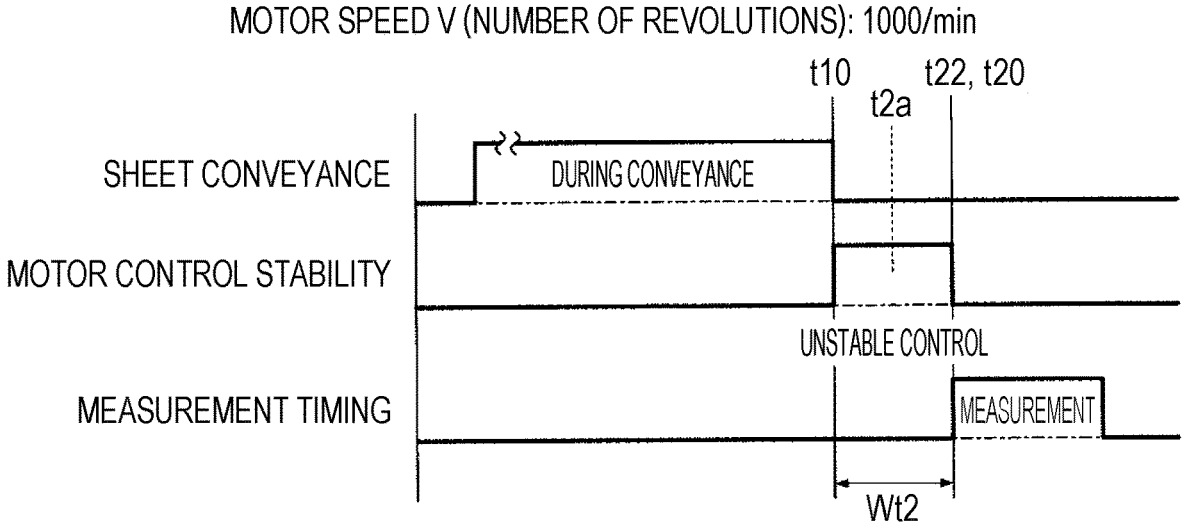

FIGS. 11A and 11B indicate exemplary measurement timings t21 and t22 of the motor current Im, respectively.

For the motor 3 that drives the rotator for conveyance of sheets 2, preferably, the motor current Im is measured after motor control unstable due to a reduction in load torque caused by passage of a sheet 2 through the rotator, recovers to the stable state.

Referring to FIG. 11A, the motor speed V is 2000/min at sheet conveyance. From passage-through-roller timing t10 at which the rotator has finished conveyance by the rotation after passage of a sheet 2 through the rotator that is the drive target, waiting time Wt1 elapses. The waiting time Wt1 is set more than expected time necessary for the motor control to recover from the unstable state to the stable state. Measurement of the motor current Im starts at the measurement timing t21 at which the waiting time Wt1 elapses. During a predetermined measurement period, the motor current Im is measured a plurality of times, so that the average value of measured results of the motor current Im can be regarded as the measured current value DIm.

Note that, with respect to the timing at which the sheet 2 passes through a position on the upstream side of the rotator in the conveyance path 10, the passage-through-roller timing t10 can be specified by calculation of the conveyance time from the position to the rotator, based on the known distance and the motor speed V.

Referring to FIG. 11B, the motor speed V is 1000/min slower than the speed in the case of FIG. 11A. In the case of FIG. 11B, waiting time Wt2 longer than the waiting time Wt1 elapses from the passage-through-roller timing t10. Measurement of the motor current Im starts at the measurement timing t22 at which the waiting time Wt2 elapses.

Figure 12A:
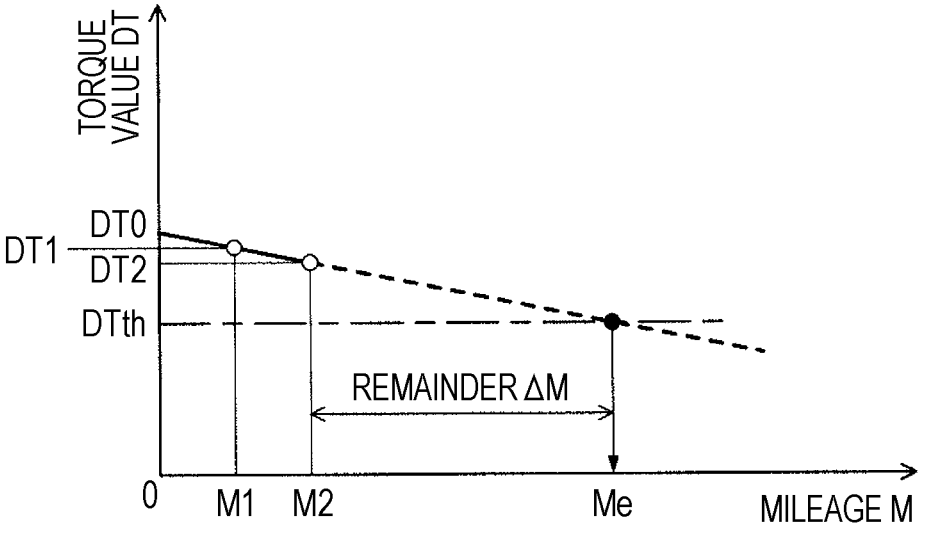
FIGS. 12A and 12B are graphs of exemplary life prediction of a rotator.
Figure 12B:
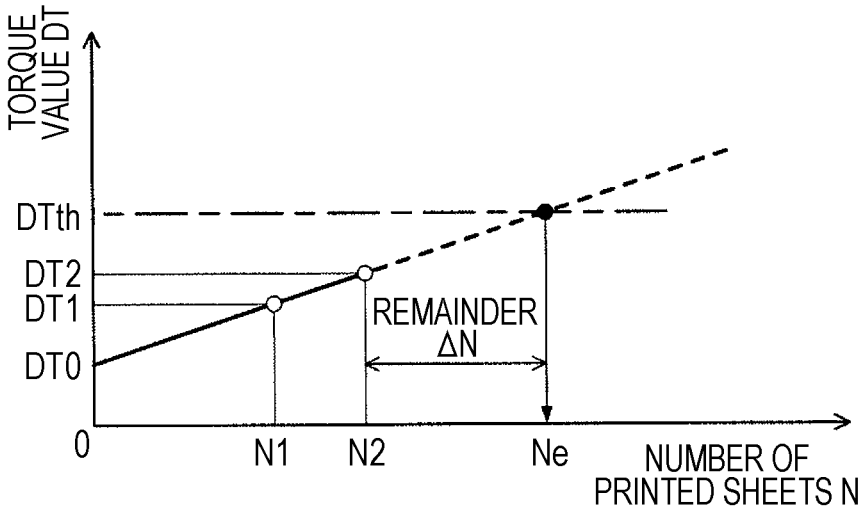

FIGS. 12A and 12B indicate exemplary determinations of the state of the rotator. In the example of FIG. 12A, the deterioration state of the roller for conveyance of sheets 2 is quantified as the remainder (rest of the life) ΔM of the life of the roller. In the example of FIG. 12B, the deterioration state of the rotator that abuts on a viscous object is quantified as the remainder ΔN of the life of the rotator.

For FIG. 12A, for example, usage causes abrasion of the circumferential face of the roller for conveyance, such as the pair of paper-feeding rollers 12 or the pair of registration rollers 13. Thus, slipping occurs, so that the conveying force to sheets 2 gradually deteriorates. The remainder ΔM can be used as an indicator for determination of the necessity of replacement of the roller.

Because slipping of the roller causes a reduction in load when observed from the motor 3, control of reducing the torque T is performed to the motor 3. That is the torque T of the motor 3 varies in accordance with the degree of abrasion of the roller. Therefore, the state of the roller can be determined from the torque value DT that is the measured value of the torque T.

Referring to FIG. 12A, the torque value DT is DT1 when the mileage of the roller (cumulative conveyance distance) M is M1, and the torque value DT is DT2 when the mileage of the roller M is M2. Note that the indicator for determination of the acquisition timing of the torque value DT, is not limited to the mileage M. For example, the number of printed sheets (cumulative number of times of printing) N may be provided.

On the basis of the acquired torque values DT1 and DT2, the rate of variation of the torque value DT in the period from the acquisition timing at the mileage M that is M1 to the acquisition timing at the mileage M that is M2, is obtained. The rate of variation is expressed by the following expression: (DT2−DT1)/(M2−M1).

On the assumption that the torque value DT varies (reduces, in this case) at the obtained rate of variation from now on, mileage Me, at the timing the torque value DT is expected to reach a previously determined threshold value DTth, is calculated. Then, the difference between Me and M2 is calculated as the remainder ΔM.

Like display of a message recommending replacement of the roller in a case where the remainder ΔM is less than a set value, previously determined processing can be performed in accordance with the remainder ΔM.

For FIG. 12B, for example, the lubricant interposed between the pad 64 and the fixing belt 61 reduces gradually in the pad-type fixer 16. The variation in age occurs due to gradual extrusion of the lubricant to each side in the width direction of the fixing belt 61 along with sliding of the fixing belt 61.

The torque T during constant-speed rotation increases as the lubricant decreases. With little lubricant, the friction between the fixing belt 61 and the pad 64 acts as load torque. Thus, the torque T increases sharply. Therefore, for example, the state of abrasion of the fixing belt 61 can be determined from the torque value DT.

Referring to FIG. 12B, the torque value DT is DT1 when the number of printed sheets N after first use of the fixing belt 61 is N1, and the torque value DT is DT2 when the number of printed sheets N is N2. Note that the indicator for determination of the acquisition timing of the torque value DT, may be the mileage M of the fixing belt 61.

On the basis of the torque values DT1 and DT2, the rate of variation of the torque value DT in the period from the acquisition timing at the number of printed sheets N that is N1 to the acquisition timing at the number of printed sheets N that is N2, is obtained. The rate of variation is expressed by the following expression: (DT2−DT1)/(N2−N1).

On the assumption that the torque value DT varies (increases, in this case) at the obtained rate of variation from now on, the number of printed sheets Ne, at the timing the torque value DT is expected to reach a previously determined threshold value DTth, is calculated. Then, the difference between Ne and N2 is calculated as the remainder ΔN.

Because the abrasion of the fixing belt 61 is highly advanced when the torque T is close to the threshold value DTth because of an increase, there is a possibility that the fixing belt 61 ruptures. Like display of a message recommending replacement of the fixing belt 61 in a case where the remainder ΔN is less than a set value, previously determined processing can be performed in accordance with the remainder ΔN.

The torque T of the motor 3 that drives the pad-type fixer 16 is influenced by a variation in the viscosity of the lubricant. When temperature control of retaining the temperature of the fixing belt 61 at a constant level is performed in the fixer 16, a temperature ripple occurs due to response delay in control. When the temperature varies, the viscosity of the lubricant fluctuates, so that the load torque varies. At this time, because of the control of constant-speed rotation being performed, the motor current Im fluctuates along with the fluctuation of the load torque.

That is there is a possibility that the measured value of the torque T of the motor 3 that drives the fixer 16 includes, as an redundant error in comparison to a case where the load torque does not vary, the amount of variation in torque corresponding to the viscosity of the lubricant and the amount of loss current dT corresponding to the amount of fluctuation of the motor current Im corresponding to the amount of variation.

Thus, for acquisition of a more accurate torque value DT, correction of the measured current value DIm or the provisional torque value DTp, corresponding to the level of the measured current value DIm corresponding to the motor current Im, is particularly more important in comparison to a case of drive of the rotator that does not have variation in the load torque due to a factor different from the variation in age.

Figure 13:
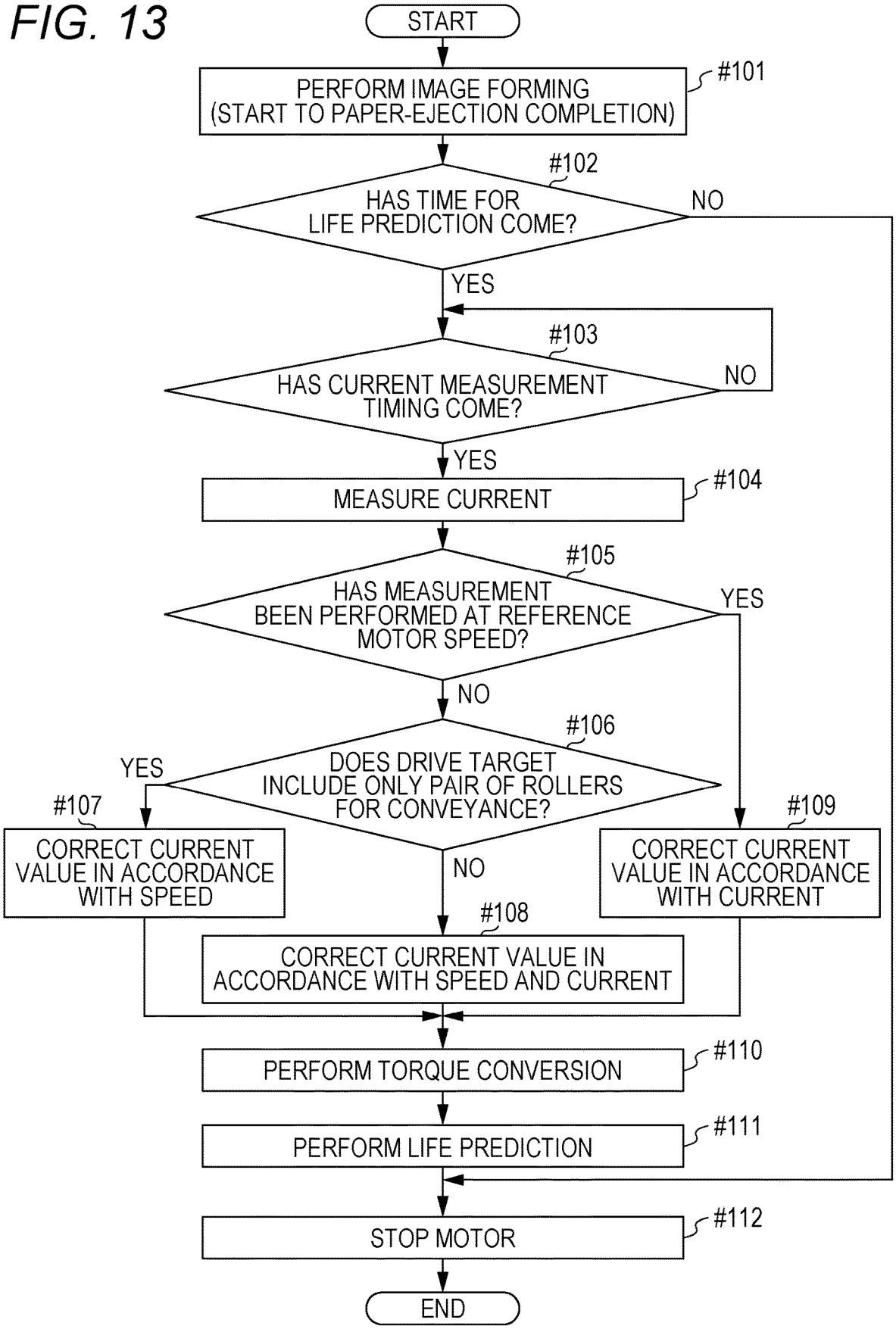
FIG. 13 is a flowchart of an exemplary flow of processing in the image forming apparatus.
Figure 14A:
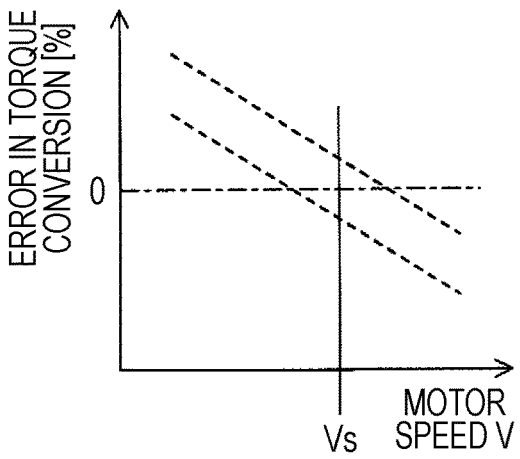
FIGS. 14A and 14B are graphs indicating an effect due to correction corresponding to motor speed.
Figure 14B:
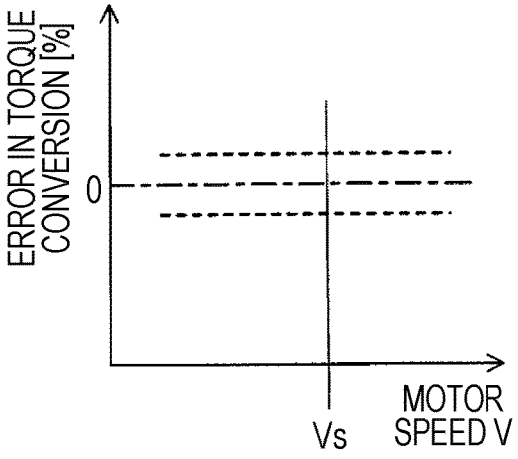

FIG. 13 illustrates an exemplary flow of processing in the image forming apparatus 1. FIGS. 14A and 14B indicate an effect due to correction corresponding to the motor speed V.

When a job is input, image forming is performed for the number of sheets specified by the job (#101). After the image forming finishes or during the image forming, it is checked whether a predetermined time for life prediction of the rotator has come (#102). In a case where the time for life prediction has not come yet (NO at #102), the processing proceeds to step #112 to cause the motor 3 to stop.

In a case where the time for life prediction has come (YES at #102), arrival of predetermined measurement timing t20 (t21 or t22) is expected (#103). Then, the motor current Im is measured (#104).

In a case where the motor speed V at the measurement timing t20 is the reference motor speed Vs (YES at #105), correction corresponding to the level of the measured current value DIm, is performed to the measured current value DIm (#109). That is the measured current value DIm is multiplied by the correction coefficient α associated with the reference motor speed Vs in the correction information 70 of FIG. 5B.

Then, the corrected measured current value ADIm is subjected to torque conversion (#110). The life prediction is performed on the basis of the latest torque value DT acquired by the torque conversion and the previously acquired and stored torque value DT (#111). After that, the motor 3 stops (#112).

In a case where the motor speed V at the measurement timing t20 is not the reference motor speed Vs (NO at #105), it is checked whether the rotator that is the drive target includes only a pair of rollers for conveyance (#106).

Differently from, for example, the pressing roller 65 influenced by the viscosity of the lubricant, with the pair of rollers for conveyance conveying no sheet 2 while being in constant-speed rotation, variation in the load torque due to a factor different from the variation in age of the roller hardly occurs. That is the necessity of the correction corresponding to the level of the measured current value DIm is lower in comparison to, for example, the pressing roller 65.

Thus, in a case where the drive target includes only the pair of rollers for conveyance (YES at #106), for the motor 3, correction corresponding to the motor speed V is performed to the measured current value DIm (#107). For example, in a case where the motor speed V and the motor current Im are substantially in proportion as indicated in FIG. 4A, the measured current value DIm is multiplied by a correction coefficient corresponding to the difference between the motor speed V and the reference motor speed Vs, uniformly, regardless of the level of the measured current value DIm. Then, the processing proceeds to step #110.

The correction corresponding to the motor speed V as described above, causes an error in the torque conversion based on the corrected measured current value ADIm, to be constant regardless of the motor speed V as indicated in FIGS. 14A and 14B.

Because the correction corresponding to the level of the measured current value DIm is not performed, correction with the lookup table method enables reduction of the volume of data of a table, and correction by computing enables reduction of the load of the processor by the amount of simplification of an arithmetic expression.

In a case where the rotator that is the drive target includes not only the pair of rollers for conveyance (NO at #106), correction corresponding to the motor speed V and the level of the measured current value DIm is performed to the measured current value DIm (#108). That is the measured current value DIm is multiplied by the correction coefficient α associated with the motor speed V that is not the reference motor speed Vs in the correction information 70 of FIG. 5B. Then, the processing proceeds to step #110.

Note that the processing at step #108 is first mode processing of performing the correction for cancellation of the amount of error based on a variation in characteristic corresponding to the motor speed V and a variation in characteristic corresponding to the motor current Im. The processing at step #107 is second mode processing of performing the correction for cancellation of the amount of error based on a variation in characteristic corresponding to the motor speed V. In addition, the processing at step #107 corresponds to processing of performing switching between the first mode and the second mode in accordance with the load torque characteristic of the rotator.

According to the embodiment, because of the correction for cancellation of the amount of loss current dT based on a variation in characteristic corresponding to the motor speed V of the motor 3 and a variation in characteristic corresponding to the motor current Im at the measurement timing of the motor current Im, a more accurate torque value DT can be acquired than ever before, with no torque sensor.

In the embodiment described above, the following Expression (5) may be used as an arithmetic expression in a case where the provisional torque value DTp is corrected to acquire the torque value DT:

$$DT=C\times DTp \tag{5}$$

In Expression (5), C represents a function expressed by the following Expression (6):

$$C=c1\times DTp+c2 \tag{6}$$

where c1 and c2 represent constants.

Substitution of Expression (6) into Expression (5) results in the following Expression (7):

$$DT=(c1\times DTp+c2)DTp=c1\times(DTp)\hat{}+c2\times DTp \tag{7}$$

Furthermore, substitution of Expression (3) into Expression (7) results in the following Expression (8):

$$DTp=Kt\times DIm \tag{3}$$

$$DT=c1\times(Kt\times DIm)\hat{}+c2\times(Kt\times DIm)=c1\times Kt\hat{}\times DIm\hat{}+c2\times Kt\times DIm \tag{8}$$

That is, depending on the characteristic of the motor 3, preferably, the torque value DT is calculated with a quadratic function including the measured current value DIm as a variable, in some cases.

According to the embodiment described above, the image forming apparatus 1 in which the motor speed V is switched in accordance with setting of the process speed, has been given, but the motor speed V may be fixed. In a case where the motor speed V is different from the reference motor speed Vs determined for unification of the speed condition for the torque value DT, correction corresponding to the difference from the reference motor speed Vs may be performed at acquisition of the torque value DT.

For example, it is considered that a server in a service center accumulates the respective torque values DT in a plurality of image forming apparatuses that is identical in the model number of the motor 3 for use and the configuration of the rotator and is different in the set value of the motor speed V (e.g., a high-speed apparatus, a medium-speed apparatus, and a low-speed apparatus), resulting in centralized management. In this case, unification of the speed condition for the torque value DT with determination of the reference motor speed Vs, facilitates the management. The value of the reference motor speed Vs may be identical to the set value of the motor speed V in any of the plurality of image forming apparatuses or may be different from the respective set values of the motor speeds V in the plurality of image forming apparatuses.

In the embodiment described above, a current sensor that measures the drive current Im0 may be provided as a measurer for the motor current Im between the direct-current power-source line 91 and the motor driver 26.

In the embodiment described above, the vector control is not limited to the sensorless vector control. There may be provided vector control of causing rotational speed ω measured with a sensor, such as a Hall element, an encoder, or a resolver, to correspond to the target speed ω*.

In addition, for example, the entire configuration of the image forming apparatus 1, the configuration of each constituent of the image forming apparatus 1, the content, the order, and the timing of processing, the configuration of the motor 3, the configuration of the motor control device 21, and the contents of the pieces of correction information 70, 70*a*, 70*b*, and 70*c* can be appropriately changed along the spirit of the present invention.

Although embodiments of the present invention have been described and illustrated in detail, the disclosed embodiments are made for purposes of illustration and example only and not limitation. The scope of the present invention should be interpreted by terms of the appended claims.

What is claimed is:

1. An image forming apparatus that forms an image on a sheet, the image forming apparatus comprising:

a rotator used to form the image;

a motor that drives the rotator rotationally;

a current measurer that measures motor current flowing through a current-carrying path including a winding of the motor, at measurement timing that is timing after the motor starts up;

a torque acquirer that acquires a torque value of the motor based on a measured value of the motor current; and a corrector that performs correction for cancellation of an amount of error based on one or both of a variation in characteristic corresponding to motor speed of the motor and a variation in characteristic corresponding to the motor current at the measurement timing, at the acquisition of the torque value by the torque acquirer.

2. The image forming apparatus according to claim 1, wherein based on information indicating, as the amount of error, an amount of loss current corresponding to the motor current for each of a plurality of values of the motor speed, the corrector performs, as the correction, processing of correcting the measured value of the motor current such that the amount of error corresponding to the motor speed and the motor current at the measurement timing is canceled.

3. The image forming apparatus according to claim 1, wherein the corrector stores a first correction value corresponding to a difference between the motor speed and reference motor speed and a second correction value corresponding to a difference between the measured value of the motor current and a reference current value, and performs the correction with the first correction value corresponding to the motor speed and the second correction value corresponding to the measured value of the motor current at the measurement timing.

4. The image forming apparatus according to claim 3, wherein the first correction value is a value proportional to m power of the difference between the motor speed and the reference motor speed, the m being an integer of one or more, and the second correction value is a value proportional to n power of the difference between the measured value of the motor current and the reference current value, the n being an integer of one or more.

5. The image forming apparatus according to claim 1, further comprising:

a motor controller that performs vector control of controlling rotation of the motor, wherein the current measurer measures, as the motor current, coil current flowing through the winding.

6. The image forming apparatus according to claim 1, further comprising:

a motor controller that performs vector control of controlling rotation of the motor, wherein the current measurer measures, as the motor current, q-axis current that is a current component causing the motor to generate rotary torque in the vector control.

7. The image forming apparatus according to claim 1, further comprising:

a life predictor that predicts a life of the rotator, based on the torque value acquired.

8. The image forming apparatus according to claim 1, wherein in a case where the rotator is a roller that conveys the sheet, the current measurer defines, when the motor speed during the conveyance is a first speed, timing at which first waiting time elapses after passage-through-roller timing at which the sheet has completely passed through the roller, as the measurement timing, and defines, when the motor speed during the conveyance is a second speed slower than the first speed, timing at which second waiting time longer than the first waiting time elapses after the passage-through-roller timing, as the measurement timing.

9. The image forming apparatus according to claim 1, wherein the corrector is switchable, in accordance with a load torque characteristic of the rotator, between first mode in which the correction for cancellation of the amount of error based on the variation in characteristic corresponding to the motor speed of the motor and the variation in characteristic corresponding to the motor current at the measurement timing is performed and second mode in which the correction for cancellation of the amount of error based on the variation in characteristic corresponding to the motor speed of the motor at the measurement timing is performed.

10. The image forming apparatus according to claim 1, further comprising:

a pad-type fixer including a pad disposed securely, a barrel-shaped fixing belt that rotates around the pad, and a pressing roller as the rotator that rotates the fixing belt, wherein lubricant is interposed between the pad and the fixing belt, and the motor is a drive source that drives the pressing roller rotationally.

* * * * *